US006098694A

United States Patent [19]

Ohanesian

[11] Patent Number: 6,098,694

[45] Date of Patent: Aug. 8, 2000

[54] USER-SIZEABLE HEADRAIL ASSEMBLY

[76] Inventor: Harout Ohanesian, 9 Tattersail La., Laguna Niguel, Calif. 92677

[21] Appl. No.: 09/234,050

[22] Filed: Jan. 19, 1999

[51] Int. Cl.[7] ..... E06B 9/30

[52] U.S. Cl. ..... 160/168.1 V; 160/178.1 V; 83/762; 29/24.5

[58] Field of Search ..... 160/166.1 R, 168.1 R, 160/168.1 V, 173 R, 173 V, 177 R, 177 V, 178.1 R, 178.1 V; 83/743, 745, 762; 29/24.5

[56] References Cited

U.S. PATENT DOCUMENTS

| | | | |
|---|---|---|---|
| 1,381,033 | 6/1921 | Thornton | 83/762 |
| 3,397,722 | 8/1968 | Long | 83/762 |
| 4,377,959 | 3/1983 | DeCarolis | 83/762 |
| 4,819,530 | 4/1989 | Huang | 29/24.5 X |
| 5,072,494 | 12/1991 | Graves et al. | 29/24.5 |
| 5,136,909 | 8/1992 | Mellick | 83/762 |
| 5,339,716 | 8/1994 | Sands et al. | 29/24.5 X |
| 5,799,557 | 9/1998 | Wang | 29/24.5 X |
| 5,806,394 | 9/1998 | Marocco | 29/24.5 X |
| 5,816,126 | 10/1998 | Pluber | 29/24.5 X |

*Primary Examiner*—Daniel P. Stodola
*Assistant Examiner*—Bruce A. Lev
*Attorney, Agent, or Firm*—Myers, Dawes & Andras LLP

[57] ABSTRACT

A user-sizeable headrail assembly that may be easily and readily cut-down to size by the consumer; includes a pre-assembled, cordless headrail and a cutting jig. The preferred headrail has an elongated track, a pinion rod, and multiple carriers which slide along the track and rod. The cutting jig is sized for removable location between a pair of carriers at a desired location along the pre-assembled headrail for simultaneously cutting the elongated track and pinion rod to divide the pre-assembled headrail into a first scrap portion and a second useful portion having a desired length that is less than the initial length. For this purpose, the cutting jig includes an upper track support portion including upper contact members that contact the opposed sides of the elongated track and a lower rod support portion including lower contact members that extends downwardly from the upper track support portion and surround the pinion rod in the interior of the elongated track.

19 Claims, 4 Drawing Sheets

USER-SIZEABLE HEADRAIL ASSEMBLY

BACKGROUND OF THE INVENTION

1. Field of the Invention

The present invention relates generally to vertical blind headrails, and more particularly, to a user-sizeable headrail assembly which may be conveniently cut-down to a desired size by retail personnel or by the consumer.

2. Description of the Related Art

Vertical blinds have become a popular window covering for both home and office applications. A vertical blind generally comprises a headrail assembly and a plurality of louvers which hang downwardly from the headrail. Vertical blind headsails are available in stock sizes, but it is often necessary to custom fit the headrail for a particular window. Up to this point, it has not generally been practical for the consumer to fit the headrail to their own windows. Typically, the consumer purchases the vertical blind from a retailer who manufactures a custom-size headrail according to measurements. Such retailers frequently use a power miter saw to cut-down individual components which are then assembled at the retailer's facility. Some retailers cut-down pre-assembled headrails, but they use a power miter saw which cuts rapidly through the pre-assembled headrail with little resistance.

The window covering market is very competitive. As such, the market is price sensitive and the consumer ultimately may choose an alternative window covering if required to pay for custom-sizing services. These custom-sizing services also required extra time. Many consumers would be willing to custom fit the headrail on site in order to save money and time. Prior to this invention, however, there has been no headrail assembly that an ordinary consumer may cut-down in a practical manner.

There remains a need, therefore, for a user-sizeable headrail assembly for vertical blinds.

SUMMARY OF INVENTION

In a first aspect, the invention may be regarded as a user-sizable headrail assembly comprising: a pre-assembled headrail of initial length having an elongated track with a bottom and opposed sides that form a substantially U-shaped profile which surrounds an interior; first and second end caps; means for securing the first and second end caps to opposite ends of the elongated track; a pinion rod located within the interior of the elongated track and rotatably supported between the first and second end caps; a control assembly that slidably engages the pinion rod and the opposed sides of the elongated track and further includes a gear mechanism for rotating the pinion rod; a plurality of carriers that slidably engage the pinion rod and the opposed sides of the elongated track and have a downwardly extending hook for supporting a vertical louver; a plurality of straps slidably connecting each carrier to an adjacent carrier such that each carrier pushes an adjacent carrier when the control assembly is moved in one direction and each carrier pulls an adjacent carrier when the control assembly is moved in an opposite direction; and a cutting jig sized for removable location between a pair of carriers at a desired location along the pre-assembled headrail for simultaneously cutting the elongated track and pinion rod to divide the pre-assembled headrail into a first scrap portion and a second useful portion having a desired length that is less than the initial length, the cutting jig having an upper track support portion including upper contact members that contact the opposed sides of the elongated track, and a lower rod support portion including lower contact members that extends downwardly from the upper track support portion and surround the pinion rod in the interior of the elongated track.

In a second aspect, the invention may be regarded as a cutting jig in combination with a vertical blind headrail including an elongated track having a bottom and opposed sides which define an interior, a pinion rod, and a plurality of carriers, a cutting jig adapted for cutting the headrail to a desired length, the cutting jig comprising: an upper portion contacting the opposed sides of the elongated track and having a transverse saw slot that extends downwardly from a top thereof; and a lower portion extending downwardly from the upper portion, surrounding the pinion rod in the interior of the elongated track, and having a solid cuttable region beneath the transverse saw slot; the cutting jig being divided into first and second sections after cutting the headrail to the desired length.

In a third aspect, the invention may be regarded as 17. A user-sizable headrail assembly comprising a cordless headrail of initial length having a bottom and opposed sides which define an interior, a pinion rod, and a plurality of carriers; and a cutting jig having an upper portion including upper contact members that contact the opposed sides of the elongated track, and a lower portion including lower contact members that extends downwardly from the upper portion and contact the pinion rod in the interior of the elongated track.

In a fourth aspect, the invention may be regarded as 20. A cutting jig adapted for use in cutting down a headrail including an elongated track having a bottom and opposed sides which define an interior, a pinion rod, and a plurality of carriers, the cutting jig comprising: an upper guide portion including upper contact members that contact the opposed sides of the elongated track and a predefined cutting slot for guiding a saw blade into an upper section of the elongated track, and a lower guide portion including lower contact members that extends downwardly from the upper portion and surround the pinion rod in the interior of the elongated track.

BRIEF DESCRIPTION OF THE DRAWINGS

The just summarized invention may best be understood with reference to the Figures of which.

BRIEF DESCRIPTION OF THE PREFERRED EMBODIMENTS

There are two general classes of headrails: (1) corded headrails which use a cord to impart lateral movement to the carriers: and (2) cordless headrails which use straps that extend from one carrier to the next. The present invention is directed specifically to cordless headrails.

This invention makes it possible to manufacture user-sizeable headrail assemblies 10. For example, the headrail assemblies 10 may come in four base sizes that users may cut-down to fit about 80% of the windows in America. As shown in FIGS. 1–5, the only tools needed to cut-down a preferred assembly 10 are a hacksaw and a screwdriver.

Figure 1:
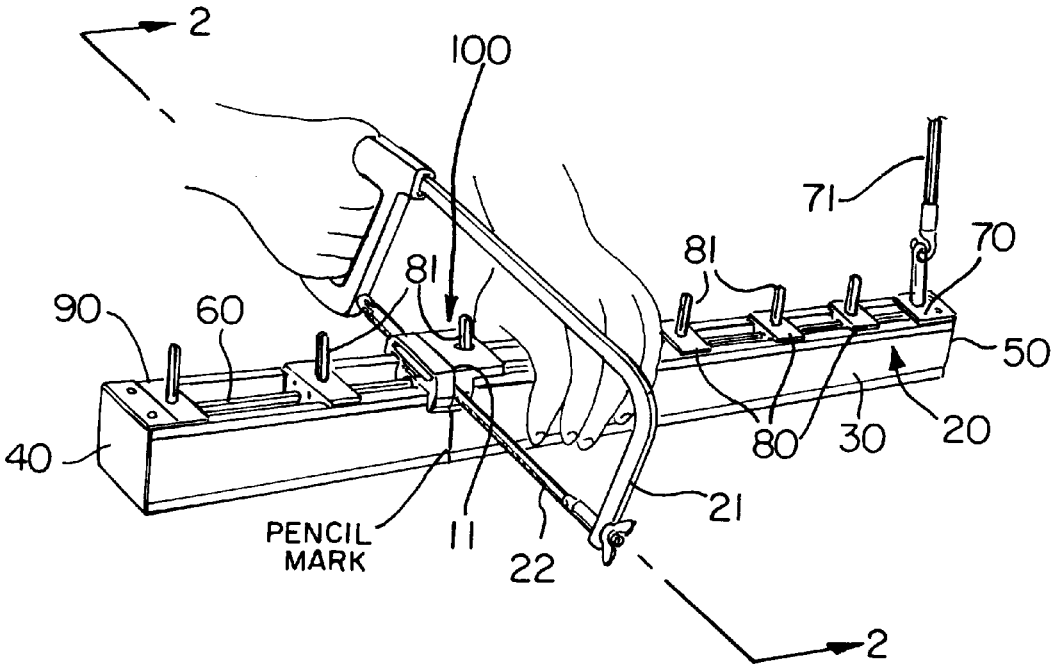
FIG. 1 is a perspective view of a first preferred user-sizeable headrail assembly according to the present invention.

FIG. 1 shows a first preferred user-sizeable headrail assembly 10 according to the present invention. As shown therein, the headrail assembly 10 generally comprises a cordless headrail 20 and a cutting jig 100.

Cordless headrails 20 are well known, but a description of the headrail 20 which forms a part of the innovative assembly 10 is useful. The Preferred headrail 20 include an elongated track 30, first and second end caps 40, 50, a rotation rod or pinion rod 60, a control assembly 70, a plurality of moveable carriers 80 with rotating clips 81, and a fixed carrier 90.

Figure 2:
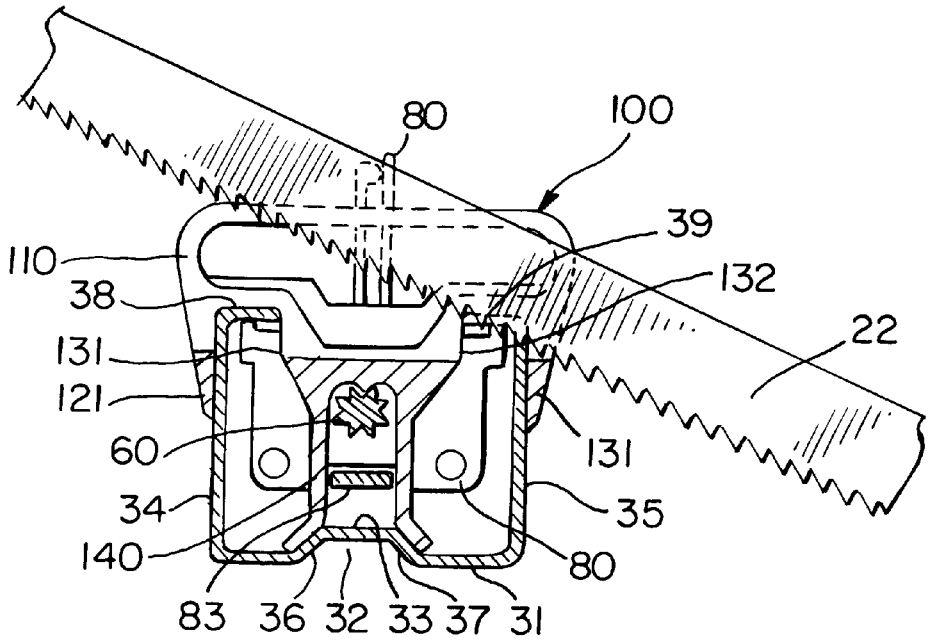
FIG. 2 is a cross-section of the user-sizeable headrail assembly of FIG. 1 taken along section lines 2—2.
Figure 10:
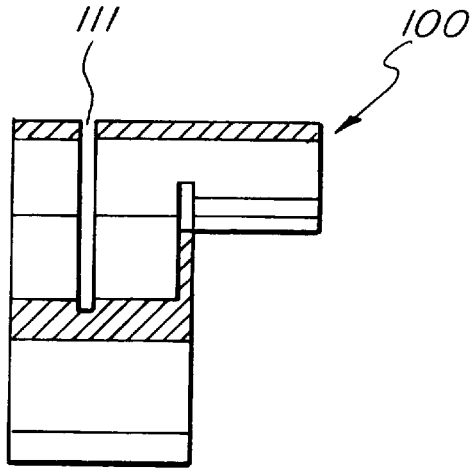
FIG. 10 is a cut-away view of the cutting jig of FIG. 6 taken along section lines 10—10.

As shown in FIG. 2, the elongated track is preferably an extruded member having a substantially U-shaped profile. The elongated track 30 further includes an elongated groove 32 which forms an internal ridge 33 having beveled side walls 36, 37 exposed to an interior of the elongated track 30. The beveled side walls 36, 37 lead to bottom walls 31. Furthermore, a pair of inwardly facing flanges 38, 39 which extend toward one another at a top end of the side walls 34, 35. The elongated track 30 is preferably formed from a material that is easily cut, such as extruded PVC, so that the consumer may easily cut-down the headrail 20 with an ordinary hack saw. It is possible, of course, to provide a headrail made of aluminum or other material, keeping in mind that such material will be more difficult to cut-down.

Figure 1A:
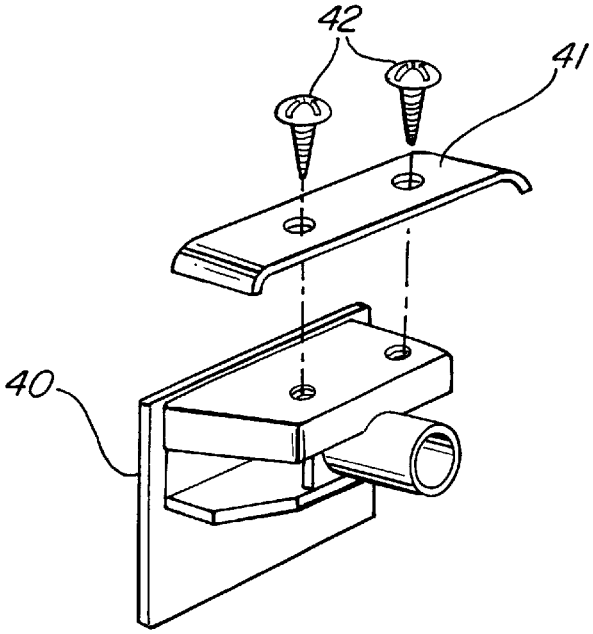
FIG. 1A is a perspective view of a first preferred end cap 40.

The preferred end caps 40, 50 are easily relocatable. In the preferred user-sizeable headrail assembly, the first end cap 40 is easily attached or detached from the headrail assembly 20 with a lateral bracket 41 and a pair of screws 42, as best shown in FIG. 1A.

The control assembly 70 laterally moves the carriers 80 and rotates the clips 81 with a single wand 71. For movement toward the first end cap 40, the user pulls the control assembly 70 toward the first end cap 40 until it contacts an adjacent carrier 80 which then contacts another adjacent carrier 80 and so on until the control assembly 70 and all of the carriers 80 are stacked up against the fixed carrier 90 adjacent the first end cap 40. For movement in the opposite direction, the user pulls the control assembly 70 for a short distance in the opposite direction until it begins to pull an adjacent carrier 80 with a strap 83 which, after it moves a short distance, begins to pull another carrier 80 with another strap 83, and so on, until the carriers 80 are spaced evenly along the headrail 20 as shown in FIG. 1. For rotation of the clips 81, the control assembly 70 includes a gear mechanism (not shown) which rotates the pinion rod 60 when the wand 71 is rotated by the user. The rotation of the pinion rod 60 is transferred to the clips 81 by way of a suitable gear mechanism in the carriers 80 (also not shown).

The cutting jig 100 which forms a part of the user-sizeable headrail assembly 10 of FIG. 1 will now be described. The preferred cutting jig 100 is formed of injection molded plastic. As shown, the cutting jig 100 contains a cutting slot 111 so that the user may conveniently cut-down the cordless headrail 20 with the saw blade 22 of a conventional hack saw 21. As best shown in FIG. 2, the preferred cutting jig 100 fits snugly between the flanges 38, 39 of the elongated track 30, firmly grips the opposed sides 34, 35 of the elongated track 30, and surrounds the pinion rod 60 such that the saw blade 22 moving within the guide slot 111 in an upper portion 110 of the cutting jig 100 is initially guided into the elongated track 30 and ultimately into a solid cuttable region in a lower portion 140 of the cutting jig 100 itself and through the pinion rod 60.

Figure 3:
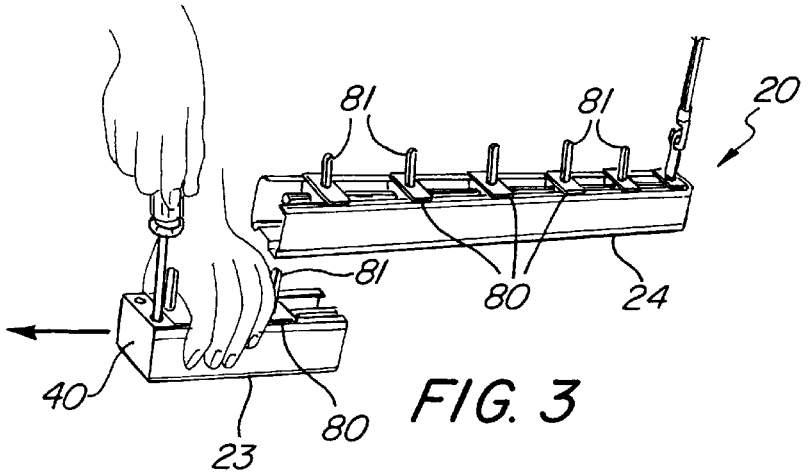
FIG. 3 is a perspective view of the first preferred user-sizeable headrail assembly of the present invention wherein a first end cap is being removed from a first scrap section.

FIG. 3 shows the headrail 20 after it has been cut-down to size. As shown, the headrail 20 is divided into a first cut-off section 23 and a second cut-down section 24 that fits a particular window. At this point, the user removes the severed strap 83 (not shown) which extended between the carrier 80 in the cut-down section 24 and the adjacent carrier 80 in the cut-off section 23. Finally, the user removes the first end cap 40 and the clip 88 which held the fixed carrier 90 against the end cap 40, and discards the rest of the first cut-off section 23.

Figure 4:
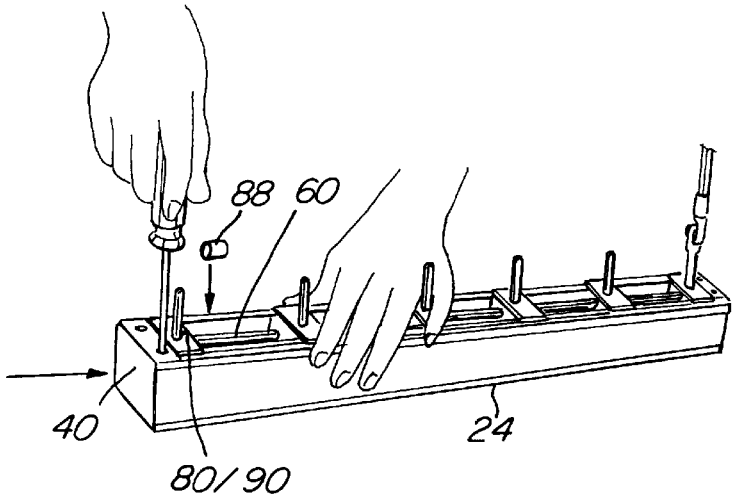
FIG. 4 is a perspective view of the first preferred user-sizeable headrail assembly of the present invention wherein the first end cap is remounted on the cut-down section and wherein and end most slave carrier is clipped adjacent to that end cap.
Figure 5:
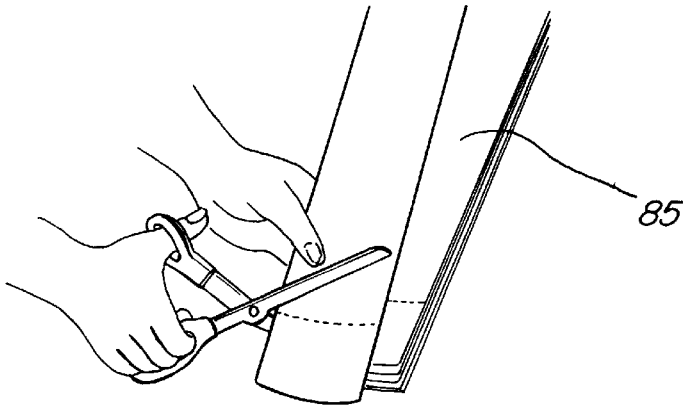
FIG. 5 is a perspective view of a trimming operation wherein the individual louvers are cut to size, if desired, with ordinary scissors.
Figure 6:
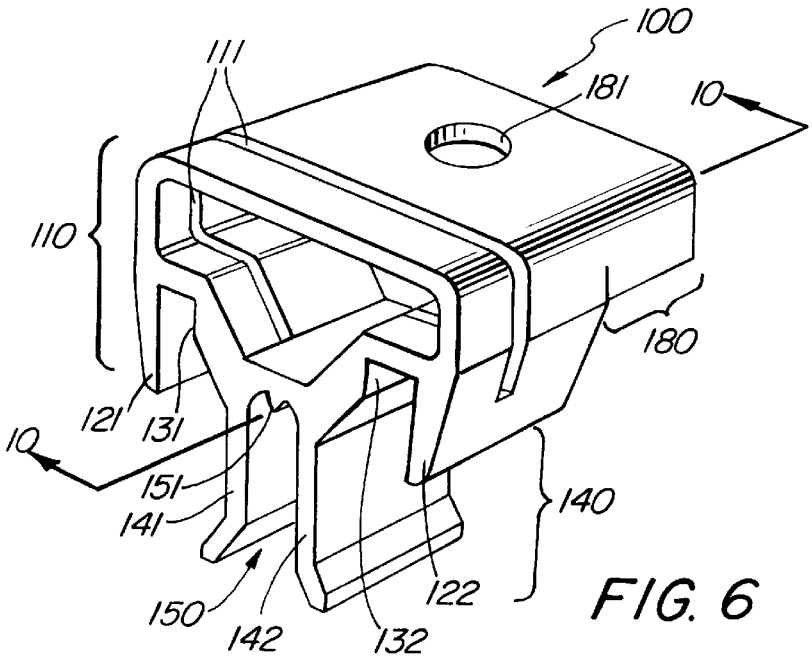
FIG. 6 is a perspective view of a preferred cutting jig according to the present invention.
Figure 7:
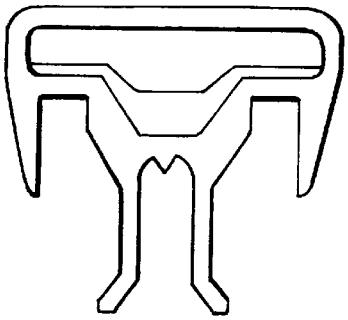
FIG. 7 is a front view of the cutting jig of FIG. 6.
Figure 8:
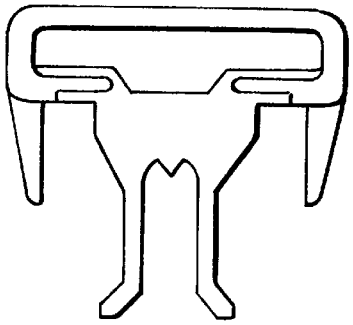
FIG. 8 is a rear view of the cutting jig of FIG. 6.
Figure 9:
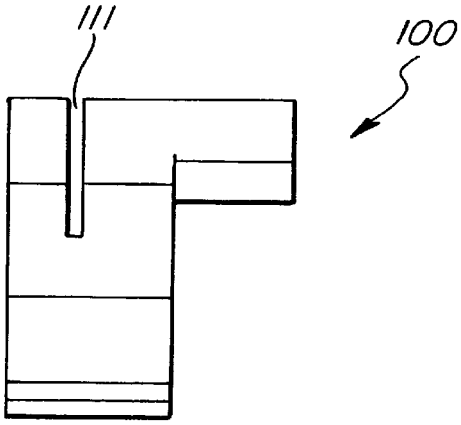
FIG. 9 is a side view of the cutting jig of FIG. 6.

Next, as shown in FIG. 4, the first end cap 40 is attached to the cut-down section 24 and the end-most one of the carriers 80 is moved next to the first end cap 40 to form a new fixed carrier 90. The clip 88 from the first scrap section 23 is pressed onto the pinion rod 60 to hold the carrier 80 against the first end cap 40. At this point, the user has successfully cut-down the headrail 20 and all that remains, if necessary, is to trim the louvers 85 to size with scissors or other cutting instrument as shown in FIG. 5.

The details of the preferred cutting jig 100 are shown in FIGS. 6–10. As shown therein, the preferred cutting jig 100 comprises an upper portion 110, and a lower portion 140 which extends downwardly from the upper portion 110. The upper portion 110 is suitably configured to contact the elongated track 30 as best shown in FIG. 2. In the preferred cutting jig 100, the upper portion 110 has first and second downwardly extending arms 121, 122 which contact the opposed sides 34, 35 of the elongated track 30 as well as internal abutting surfaces 131, 132 which contact the inwardly extending flanges 38, 39 of the elongated track 30. It is possible, of course, to provide a cutting jig which only has internal abutting surfaces 131, 132 or only has downwardly extending arms 121, 122, but the preferred cutting jig 100 employs both elements. As best shown in FIGS. 1 and 2, when the preferred cutting jig 100 is mounted on the headrail 20, the guide slot 111 preferably extends below an upper edge of the opposed side walls 34, 35 of the elongated track 30. As such, the saw blade begins to cut into the elongated track 30 before cutting into the lower portion 140 of the cutting jig 100 itself.

The lower portion 140 of the preferred cutting jig 100 includes a first and second downwardly extending legs 141, 142 that define a downwardly extending notch 150. When the cutting jig 100 is installed as shown in FIG. 2, the notch 150 which receives the pinion rod 60 such that the first and second legs 141, 142 surround the pinion rod 60. The lower portion 140 of the preferred cutting jig further includes a tooth 151 at an upper end of the notch 150 which engages the pinion rod 60 and helps prevent the pinion rod 60 from rotating during the cutting operation.

Finally, the preferred cutting jig 100 includes a cantilevered portion 180 which extends laterally from the upper portion 110 and contains an aperture 181 which suitably receives a louver clip 81 as best shown in FIGS. 1 and 2. The cantilevered portion 180 and aperture 181 help further secure the pinion rod 60 by constraining a carrier 80 which supports that pinion rod 60 closely adjacent to the cutting jig 100 and its guide slot 111.

I claim:

1. A user-sizable headrail assembly comprising:

a pre-assembled headrail of initial length having:

an elongated track with a bottom and opposed sides that form a substantially U-shaped profile which surrounds an interior;

first and second end caps;

means for securing the first and second end caps to opposite ends of the elongated track;

a pinion rod located within the interior of the elongated track and rotatably supported between the first and second end caps;

a control assembly that slidably engages the pinion rod and the opposed sides of the elongated track and further includes a gear mechanism for rotating the pinion rod;

a plurality of carriers that slidably engage the pinion rod and the opposed sides of the elongated track and have a downwardly extending hook for supporting a vertical louver;

a plurality of straps slidably connecting each carrier to an adjacent carrier such that each carrier pushes an adjacent carrier when the control assembly is moved in one direction and each carrier pulls an adjacent carrier when the control assembly is moved in an opposite direction; and a cutting jig sized for removable location between a pair of carriers at a desired location along the pre-assembled headrail for simultaneously cutting the elongated track and pinion rod to divide the pre-assembled headrail into a first scrap portion and a second useful portion having a desired length that is less than the initial length, the cutting jig having an upper track support portion including upper contact members that contact the opposed sides of the elongated track, and a lower rod support portion including lower contact members that extends downwardly from the upper track support portion and surround the pinion rod in the interior of the elongated track.

2. The user-sizable headrail assembly of claim 1 wherein the first end cap is initially secured to the first scrap portion and is thereafter moveable from the first scrap portion to the second useful portion to complete a headrail of desired length.

3. The user-sizable headrail assembly of claim 1 wherein the upper track support portion further comprises a predefined cutting slot extending transverse to the elongated track.

4. The user-sizable headrail assembly of claim 3 wherein the lower contact members lower rod support portion extending downwardly from the upper track support portion comprises a solid area located below the predefined cutting slot.

5. The user-sizable headrail assembly of claim 1 wherein the upper portion of the cutting jig further comprises a cantilevered portion with an aperture therein for receiving the hook of a carrier which carrier, in turn, further supports the pinion rod.

6. The user-sizable headrail assembly of claim 1 wherein the upper track support portion of the cutting jig comprises first and second downwardly extending arms which engage the opposed sides of the elongated track.

7. The user-sizable headrail assembly of claim 1 wherein the lower rod support portion of the cutting jig comprises first and second downwardly extending legs which surround the pinion rod.

8. The user-sizable headrail assembly of claim 7 wherein the lower rod support portion of the cutting jig further comprises first and second feet at bottom ends of the first and second downwardly extending legs, respectively, which feet contact the bottom of the track to provide further support.

9. The user-sizable headrail assembly of claim 1 further comprising:

a plurality of parallel, elongated splines extending along the pinion rod; and a tooth which extends downwardly from the rod support portion of the cutting jig and in between a pair of the plurality of parallel elongated splines and thereby prevents the pinion rod from rotating.

10. The user-sizable headrail assembly of claim 1 wherein the elongated track is formed from extruded PVC.

11. The user-sizable headrail assembly of claim 1 further comprising a wand connected to a first carrier for sliding the first carrier along the track and for rotating the spindle rod.

12. The user-sizable headrail assembly of claim 1 further comprising a clip for securing an endmost one of the plurality of carriers against the first end cap.

13. In combination with a vertical blind headrail including an elongated track having a bottom and opposed sides which define an interior, a pinion rod, and a plurality of carriers, a cutting jig adapted for cutting the headrail to a desired length, the cutting jig comprising:

an upper portion contacting the opposed sides of the elongated track and having a transverse saw slot that extends downwardly from a top thereof; and a lower portion extending downwardly from the upper portion, surrounding the pinion rod in the interior of the elongated track, and having a solid cuttable region beneath the transverse saw slot;

the cutting jig being divided into first and second sections after cutting the headrail to the desired length.

14. The combination of claim 13 wherein the upper portion comprises a central body and a pair of spaced, downwardly extending arms which surround the elongated track.

15. The combination of claim 13 wherein the lower portion comprises first and second downwardly extending legs which define a downwardly-opening notch that receives the pinion rod.

16. The combination of claim 15 wherein the lower portion further comprises first and second feet extending from the first and second downwardly extending legs, respectively, the first and second feet contacting a bottom of the elongated track.

17. A user-sizable headrail assembly comprising:

a cordless headrail of initial length having a bottom and opposed sides which define an interior, a pinion rod, and a plurality of carriers; and a cutting jig having an upper portion including upper contact members that contact the opposed sides of the elongated track, and a lower portion including lower contact members that extends downwardly from the upper portion and contact the pinion rod in the interior of the elongated track.

18. The user-sizable headrail assembly of claim 17 wherein the upper contact members that contact the opposed sides of the elongated track surround the opposed sides of the elongated track.

19. The user-sizable headrail assembly of claim 17 wherein the lower contact members that extend downwardly from the upper portion and contact the pinion rod in the interior of the elongated track surround the pinion rod.

* * * * *